US008626046B2

(12) United States Patent
Sekihara et al.

(10) Patent No.: US 8,626,046 B2
(45) Date of Patent: Jan. 7, 2014

(54) IMAGE HEATING APPARATUS, PRESSURE ROLLER TO BE USED IN THE IMAGE HEATING APPARATUS, AND MANUFACTURING METHOD FOR THE PRESSURE ROLLER

(75) Inventors: Yuko Sekihara, Tokyo (JP); Norio Hashimoto, Odawara (JP); Hiroaki Sakai, Mishima (JP); Hiroyuki Sakakibara, Yokohama (JP); Atsushi Iwasaki, Susono (JP); Kazuo Kishino, Yokohama (JP); Masaaki Takahashi, Yokohama (JP); Katsuhisa Matsunaka, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 293 days.

(21) Appl. No.: 13/128,534

(22) PCT Filed: Dec. 24, 2009

(86) PCT No.: PCT/JP2009/071860
§ 371 (c)(1),
(2), (4) Date: May 10, 2011

(87) PCT Pub. No.: WO2010/074320
PCT Pub. Date: Jul. 1, 2010

(65) Prior Publication Data

US 2011/0217092 A1 Sep. 8, 2011

(30) Foreign Application Priority Data

Dec. 24, 2008 (JP) ..... 2008-328015

(51) Int. Cl.
*G03G 15/20* (2006.01)
*H05B 1/00* (2006.01)

(52) U.S. Cl.
USPC ..... 399/328; 399/331; 399/339; 219/216

(58) Field of Classification Search
USPC ..... 399/328, 331, 339; 156/242; 219/201, 219/216
See application file for complete search history.

(56) References Cited

U.S. PATENT DOCUMENTS 5,011,401 A * 4/1991 Sakurai et al. ..... 432/60
6,002,910 A * 12/1999 Eddy et al. ..... 399/329

(Continued)

FOREIGN PATENT DOCUMENTS

CN 1673895 A 9/2005
CN 101268423 A 9/2008

(Continued)

OTHER PUBLICATIONS

Chinese Office Action dated Mar. 7, 2013, issued in counterpart Chinese Application No. 200980151436.8, and English-language translation thereof.

(Continued)

*Primary Examiner* — David Gray
*Assistant Examiner* — Francis Gray
(74) *Attorney, Agent, or Firm* — Fitzpatrick, Cella, Harper & Scinto

(57) ABSTRACT

The image heating apparatus includes a rubber layer and a resin tube layer on a metal core. The rubber layer includes a solid rubber layer having a thermal conductivity in a thickness direction of 0.16 W/(m·K) or more and 0.40 W/(m·K) or less, and a self-bonded silicone rubber layer that contains a filler of 5 vol % or more and 40 vol % or less, and has a thermal conductivity in an axial direction of 2.5 W/(m·K) or more and a thickness of 0.5 mm or more and 5.0 mm or less, the filler having a length of 0.05 mm or more and 1 mm or less and a thermal conductivity in a length direction of 500 W/(m·K) or more, so that a pressure roller to moderate temperature rise in a non-sheet feeding area when a small sized recording material has undergone sheet feeding can be easily manufactured.

13 Claims, 7 Drawing Sheets

(56) References Cited

U.S. PATENT DOCUMENTS

| | | | | |
|---|---|---|---|---|
| 6,108,906 | A * | 8/2000 | Fujita et al. | 29/895.211 |
| 7,193,181 | B2 | 3/2007 | Makihira et al. | |
| 7,215,916 | B2 | 5/2007 | Kishino et al. | |
| 7,242,895 | B2 | 7/2007 | Inada et al. | |
| 7,283,145 | B2 | 10/2007 | Kato et al. | |
| 7,305,208 | B2 | 12/2007 | Inoue et al. | |
| 7,321,746 | B2 * | 1/2008 | Sakakibara et al. | 399/333 |
| 7,366,455 | B2 | 4/2008 | Iwasaki et al. | |
| 7,457,577 | B2 * | 11/2008 | Matsunaka et al. | 399/333 |
| 7,469,120 | B2 | 12/2008 | Iwasaki et al. | |
| 7,558,519 | B2 | 7/2009 | Jinzai et al. | |
| 7,734,241 | B2 | 6/2010 | Nishida et al. | |
| 7,974,563 | B2 | 7/2011 | Sakai et al. | |
| 7,979,015 | B2 * | 7/2011 | Matsunaka et al. | 399/333 |
| 8,224,223 | B2 | 7/2012 | Sakakibara et al. | |
| 2005/0214044 | A1 * | 9/2005 | Sakakibara et al. | 399/333 |
| 2009/0003902 | A1 | 1/2009 | Sakakibara et al. | |
| 2009/0047048 | A1 * | 2/2009 | Ikeda et al. | 399/333 |
| 2011/0082260 | A1 | 4/2011 | Omata et al. | |
| 2011/0091252 | A1 | 4/2011 | Sekihara et al. | |
| 2012/0014726 | A1 | 1/2012 | Sekihara et al. | |

FOREIGN PATENT DOCUMENTS

| | | | |
|---|---|---|---|
| JP | 11-231706 | A | 8/1999 |
| JP | 2001-312169 | | 11/2001 |
| JP | 2002-351243 | | 12/2002 |
| JP | 2005-273771 | | 10/2005 |
| JP | 2005-292218 | | 10/2005 |
| JP | 2007-101736 | | 4/2007 |
| JP | 2008-268469 | | 11/2008 |
| WO | 2008/026296 | | 3/2008 |
| WO | 2008/026296 | A1 | 3/2008 |

OTHER PUBLICATIONS

Jun. 29, 2011 International Preliminary Report on Patentability, and Mar. 30, 2011 Written Opinion of the International Searching Authority, and Jul. 7, 2011 Notice Concerning Transmittal of International Preliminary Report on Patentability, in International Application No. PCT/JP2009/071860.

* cited by examiner

IMAGE HEATING APPARATUS, PRESSURE ROLLER TO BE USED IN THE IMAGE HEATING APPARATUS, AND MANUFACTURING METHOD FOR THE PRESSURE ROLLER

TECHNICAL FIELD

The present invention relates to an image heating apparatus suitable for use as a fixing apparatus to be mounted on an image forming apparatus such as an electrophotographic copier and an electrophotographic printer, and relates to a pressure roller to be used in the image heating apparatus and a manufacturing method for the pressure roller.

BACKGROUND ART

A fixing apparatus of a heat roller system to be mounted on one of a printer and a copier of an electrophotographic system includes a halogen heater, a fixing roller heated by the halogen heater, and a pressure roller brought into contact with the fixing roller to form a nip portion. In addition, a fixing apparatus of a film heating system includes a heater including a heat generating resistor on a substrate made of ceramics, a fixing film moving while being held in contact with the heater, and a pressure roller forming a nip portion with the heater through the fixing film. In each of the fixing apparatus of the heat roller system and the fixing apparatus of the film heating system, while a recording material bearing an unfixed toner image is pinched and conveyed at the nip portion, the toner image is heated and fixed onto the recording material.

Regarding the above-mentioned fixing apparatuses, it is known that, when printing is performed on a small sized recording material continuously at the same print interval as the interval in a case of a large sized recording material, temperature rises extremely in a non-sheet feeding area (hereinafter, referred to as temperature rise at a non-sheet feeding portion).

The temperature rise at the non-sheet feeding portion is more likely to occur as process speed of the printer gets faster. The reason is that an intensive increase in speed is accompanied by shortening in time for the recording material to pass the nip portion and, therefore, fixing temperature required for heating and fixing a toner image onto the recording material is made frequently higher. When the temperature rise at the non-sheet feeding portion occurs in this way, respective parts configuring the fixing apparatus may be damaged. In addition, when printing is performed on a large sized recording material in a state of the temperature rise at the non-sheet feeding portion, toner is melted more than necessary in an area corresponding to the non-sheet feeding area in the recording material. Therefore, high-temperature offset takes place.

For the purpose of preventing the above-mentioned problem, as a unit of reducing the temperature rise at the non-sheet feeding portion, a method of increasing a thermal conductivity in an axial direction of a pressure roller is known. An advantage is that positive improvement in heat transfer in a rubber layer formed in the pressure roller leads to promote heat transmission in the axial direction so as to moderate extreme temperature rise at the non-sheet feeding portion.

Japanese Patent Application Laid-Open No. 2005-273771 discloses a pressure roller provided with a rubber layer containing dispersed pitch-based carbon fiber. In such pressure roller, the thermal conductivity in the axial direction of the rubber layer is high, and hence the temperature rise at the non-sheet feeding portion is effectively moderated.

The pressure roller disclosed in Japanese Patent Application Laid-Open No. 2005-273771 is excellent in the thermal conductivity in a roller axis direction. However, simultaneously, the pressure roller is turned out to give rise to a problem that the thermal conductivity in a thickness direction of the rubber layer is increased and heat is easily transferred from the rubber layer to the metal core so that a surface temperature of the pressure roller is likely to decrease. In a case where the surface temperature of the pressure roller is extremely low, moisture generated when the recording material passes a nip portion is likely to form dew on the surface of pressure roller to unstabilize conveyance of the recording material.

Further, even in a method of dispersing an needle-shaped filler having high thermal conductivity in a rubber layer, the rubber layer is required to have a certain amount of thickness in order to ensure satisfactory heat transfer in the roller axis direction while preventing hardness of the rubber layer from being extremely high. As a method of manufacturing a pressure roller which has a thickness enough to contain the needle-shaped filler and includes a resin tube layer excellent in die-releasing property as a surface layer, there is known a method of placing a metal core at the center of a molding die having a cylindrical inner surface, placing the resin tube on the inner surface of the molding die, and injecting liquid-state rubber between the metal core and the resin tube.

However, a step of applying primer on an inner surface of the resin tube is necessary. As a result, the number of steps of manufacturing the pressure roller is increased.

DISCLOSURE OF THE INVENTION

An object of the present invention is to provide an image heating apparatus for heating a toner image formed on a recording material, including: a heat member for heating the toner image formed on the recording material; and a pressure roller including a metal core, a rubber layer, and a resin tube layer serving as a surface layer, the pressure roller forming, in cooperation with the heat member, a nip portion at which the recording material is pinched and conveyed, in which: the rubber layer includes a solid rubber layer having a thermal conductivity in a thickness direction of 0.16 W/m·K or more and 0.40 W/m·K or less, and a self-bonded silicone rubber layer provided between the solid rubber layer and the resin tube layer, the self-bonded silicone rubber layer having a thickness of 0.5 mm or more and 5.0 mm or less; and the self-bonded silicone rubber layer contains needle-shaped fillers at 5 vol % or more and 40 vol % or less, and has a thermal conductivity of 2.5 W/m·K or more in an axial direction of the pressure roller, the needle-shaped fillers having an average length of 0.05 mm or more and 1 mm or less and a thermal conductivity of 500 W/m·K or more in an axial direction of the needle-shaped filler.

Another object of the present invention is to provide a pressure roller to be used in an image heating apparatus for heating a toner image formed on a recording material, including: a metal core; a rubber layer; and a resin tube layer serving as a surface layer, in which: the rubber layer includes a solid rubber layer having a thermal conductivity in a thickness direction of 0.16 W/m·K or more and 0.40 W/m·K or less, and a self-bonded silicone rubber layer provided between the solid rubber layer and the resin tube layer, the self-bonded silicone rubber layer having a thickness of 0.5 mm or more and 5.0 mm or less; and the self-bonded silicone rubber layer contains needle-shaped fillers at 5 vol % or more and 40 vol % or less, and has a thermal conductivity of 2.5 W/m·K or more in an axial direction of the pressure roller, the needle-shaped fillers having an average length of 0.05 mm or more and 1 mm or less and a thermal conductivity of 500 W/m·K or more in an axial direction of the needle-shaped filler.

Still another object of the present invention is to provide a manufacturing method for a pressure roller to be used in an image heating apparatus, the pressure roller including: a metal core; a resin tube layer serving as a surface layer; a solid rubber layer having a thermal conductivity in a thickness direction of 0.16 W/m·K or more and 0.40 W/m·K or less; and a self-bonded silicone rubber layer provided between the solid rubber layer and the resin tube layer, the self-bonded silicone rubber layer contains needle-shaped fillers at 5 vol % or more and 40 vol % or less, and has a thermal conductivity of 2.5 W/m·K or more in an axial direction of the pressure roller, the needle-shaped fillers having an average length of 0.05 mm or more and 1 mm or less and a thermal conductivity of 500 W/m·K or more in an axial direction of the needle-shaped filler, the manufacturing method including: placing the metal core provided with the solid rubber layer at a center of a molding die having a cylindrical inner surface; placing the resin tube layer on the inner surface of the molding die; injecting liquid addition type silicone rubber containing an adhesion-imparting agent and the needle-shaped fillers between the resin tube layer and the metal core provided with the solid rubber layer; and hardening the liquid addition type silicone rubber and bonding the resin tube layer and the liquid addition type silicone rubber together by an action of the adhesion-imparting agent.

According to the present invention, it is possible to manufacture a pressure roller having excellent performance in preventing temperature rise at the non-sheet feeding portion and in conveying the recording material with the reduced number of manufacturing steps.

Further features of the present invention will become apparent from the following description of exemplary embodiments with reference to the attached drawings.

REFERENCE SIGNS LIST

Figure 1:
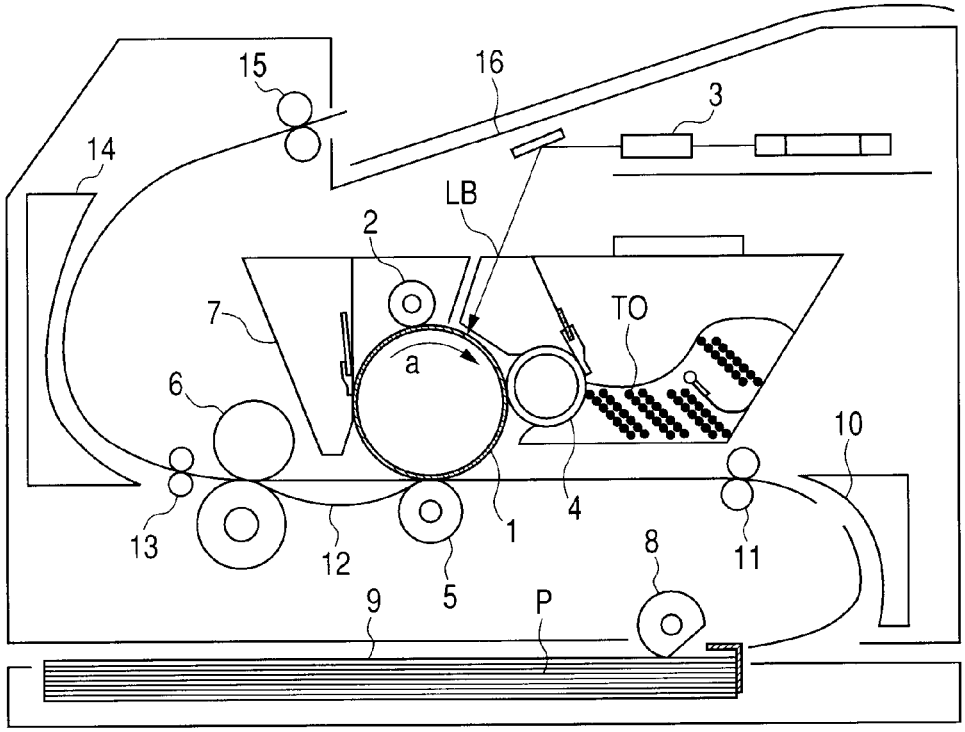
FIG. 1 is a schematic configuration diagram of a model of an example of an image forming apparatus.

1 photosensitive drum
2 charging roller
3 laser beam scanner
4 developing apparatus
5 transferring roller
6 heat fixing apparatus
7 cleaning apparatus
8 feeding roller
9 sheet feeding cassette
10 guide
11 registration roller
12 conveyance guide
13 conveyance roller
14 guide
15 discharging roller
16 discharge tray
21 film guide member
22 heater
23 film
24 pressure roller
**24*f*** first rubber layer
**24*a*** second rubber layer
**24*b*** resin tube layer
LB laser beam
TO toner
P recording material
N nip
T tape
S sensor

BEST MODE FOR CARRYING OUT THE INVENTION

The present invention is described with reference to the drawings.

(1) Example of Image Forming Apparatus

FIG. 1 is a schematic configuration diagram of a model of an example of an image forming apparatus mounting an image heating apparatus according to the present invention as a heat fixing apparatus. The image forming apparatus is a laser beam printer of an electrophotographic system.

A printer illustrated in this example includes an electrophotographic photosensitive member of a rotation drum type (hereinafter, referred to as photosensitive drum) 1 as an image bearing member. The photosensitive drum 1 is configured by forming a photosensitive material layer such as OPC, amorphous Se, and amorphous Si on an outer peripheral surface of a cylindrical (drum-like) conductive base member made of material selected from the group consisting of aluminum and nickel.

The photosensitive drum 1 is driven to rotate at a predetermined circumferential velocity (process speed) in a clockwise direction of an arrow a and the outer peripheral surface (surface) of the photosensitive drum 1 undergoes a charging process uniformly during the procedure of the rotation to attain predetermined polarity and potential with a charging roller 2 as a charge means. The uniform charging surface on the surface of the photosensitive drum 1 undergoes scan exposure with a laser beam LB modulated and controlled (ON/OFF controlled) corresponding with image information being output from a laser beam scanner 3 and. Thus, an electrostatic latent image corresponding with the image information being an object is formed on the surface of the photosensitive drum 1.

The latent image is developed and visualized by using toner TO as an unfixed toner image by a developing apparatus 4 serving as a developing unit. The developing step selected from the group consisting of jumping development method, 2-component development method, and FEED development method is used, and is frequently used in combination with image exposure and inversion development.

Meanwhile, one sheet of recording material P stacked and housed inside a sheet feeding cassette 9 is discharged each time by driving a feeding roller 8 and is conveyed to a registration roller 11 through a sheet path including a guide 10. The recording material P is fed to a transferring nip portion between the surface of the photosensitive drum 1 and an outer peripheral surface (surface) of a transferring roller 5 by the registration roller 11. The fed recording material P is pinched and conveyed at the transferring nip portion. A toner image on the surface of the photosensitive drum 1 is sequentially transferred onto the surface of the recording material P by a transferring bias applied to the transferring roller 5 during the conveyance procedure. As a result, the recording material P bears a toner image which is not yet fixed.

The recording material P bearing a toner image which is not yet fixed (unfixed toner image) is sequentially separated from the surface of the photosensitive drum 1, is discharged from the transferring nip portion, and is introduced into a nip portion of a heat fixing apparatus 6 through a conveyance guide 12. The recording material P receives heat and pressure by the nip portion of the fixing apparatus 6 so that the toner image is heated and fixed onto the surface of the recording material P, thereby adhering thereto.

The recording material P coming out from the fixing apparatus 6 is printed and discharged to a discharge tray 16 via a sheet path including a conveyance roller 13, a guide 14, and a discharging roller 15.

In addition, the surface of the photosensitive drum 1 after separation of recording material undergoes processing for removing adhesive contaminator such as residual toner subjected to transferring to form cleaned surface by a cleaning apparatus 7 as a cleaning unit and is served for repetitious image forming.

A printer of this example is a printer accepting A3 sized sheet at print speed of 50 sheets/minute for the longitudinal side of A4 sized sheet. In addition, toner including a styrene acryl resin as main material with a glass transition point of 55 to 65° C. obtained by one of internally adding and externally adding material selected from the group consisting of a charge controlling agent, magnetic material, and silica corresponding to necessity.

(2) Fixing Apparatus (Image Heating Apparatus) 6

Figure 2:
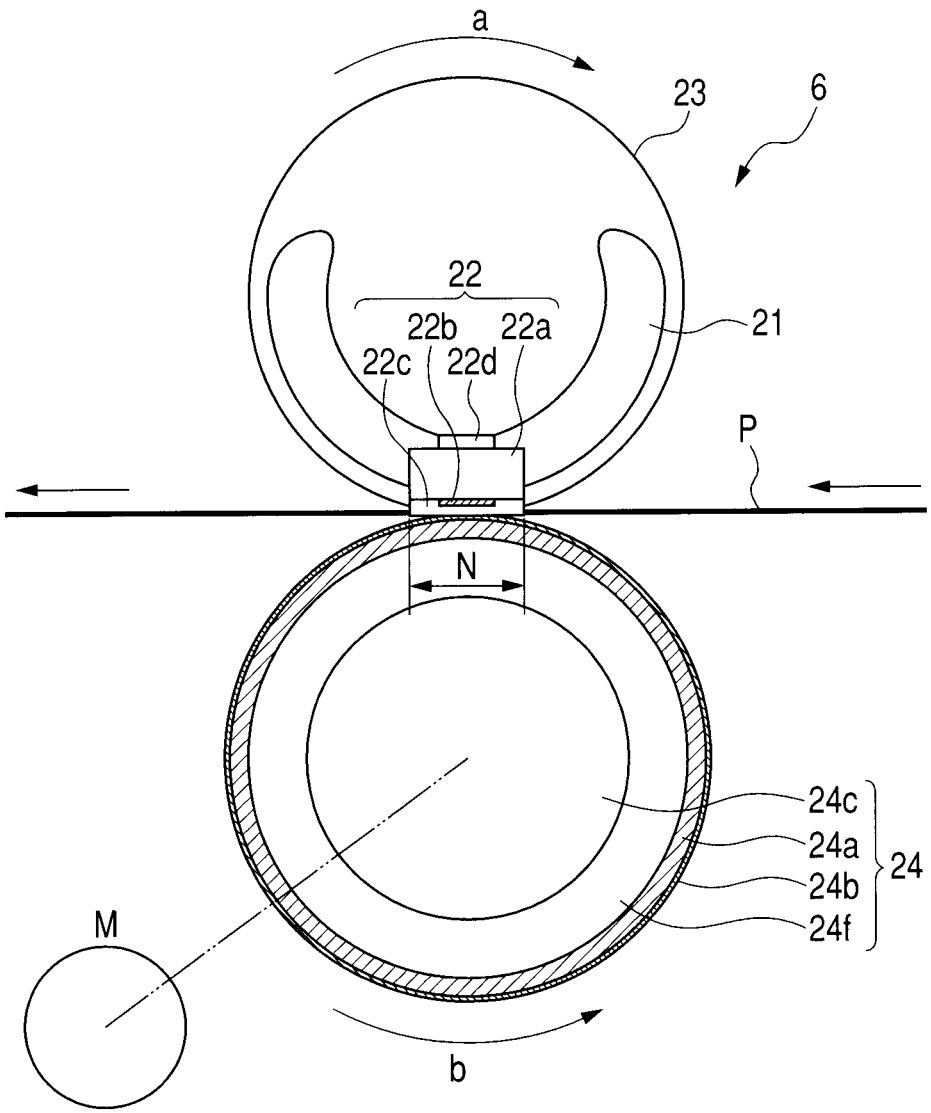
FIG. 2 is a schematic configuration diagram of a model of a fixing apparatus.

FIG. 2 is a schematic configuration sectional view of the fixing apparatus 6. The fixing apparatus 6 is a fixing apparatus of a film heating system, and the schematic configuration thereof is described below.

The fixing apparatus 6 includes a film guide member 21, a heater 22 serving as one element constituting a heat member, and an endless belt 23 (hereinafter, referred to as film) serving as another element constituting the heat member. The film guide member 21 is longitudinal, and has a cross-section of a substantially half-circular tub shape. A longitudinal direction of the film guide member 21 is perpendicular to a paper surface. The heater 22 is longitudinal, and is housed and held in a groove formed in the substantially center portion on a bottom surface of the film guide member 21 along the longitudinal direction. The film 23 has a cylindrical shape, and is fitted onto the film guide member 21 provided with the heater 22. The film guide member 21 is a molding product made of a heat resistant resin selected from the group consisting of polyphenylene sulfite (PPS) and liquid polymer.

The heater 22 (hereinafter, referred to as heating member) has a structure in which a resistant heat-generating member is provided on a ceramic substrate. The heating member 22 described in this example includes a longitudinal and thin plate-like heater substrate 22*a* such as alumina and a power supplying heat-generating member (heat-generating resistor) 22*b* including wire like or narrow belt like Ag/Pd formed along the longitudinal side of the surface (film sliding surface side) of the heater substrate 22*a*. In addition, the heating member 22 includes a thin surface protection layer 22*c* such as a glass layer covering to protect the power supplying heat-generating member 22*b*. A temperature detecting element 22*d* such as a thermistor is held in contact with a back surface side of the heater substrate 22*a*. The heating member 22 is controlled to maintain a predetermined fixing temperature (target temperature) by power controlling system (not shown) including the temperature detecting element 22*d* after prompt temperature rising by power supply to the power supplying heat-generating member 22*b*.

The film 23 is a composite layer film having undergone coating of a surface layer on the surface of a base film with total film thickness of 100 μm or less, suitably 20 μm or more and 60 μm or less in order to reduce heat capacity to improve quick starting performance of the apparatus. A material used for the base film is selected from a resin material such as PI (polyimide), PAI (polyamideimide), PEEK (polyether ether ketone), and PES (polyether sulfone), and a metal material such as SUS and Ni. A material used for the surface layer is selected from a fluororesin material such as PTFE (polytetrafluoroethylene), PFA (tetrafluoroethylene-perfluoroalkyl vinyl ether), and FEP (tetrafluoroethylene-perfluoroalkyl vinyl ether).

A longitudinal pressure roller 24 serving as a pressure member pinches the film 23 and is brought into pressure-contact to the bottom surface of the heating member 22. The pressure roller 24 includes a metal core 24*c* made of material such as iron and aluminum, a rubber layer 24*a* obtained by using material and a manufacturing method described in detail in the following item (3), and a tube 24*b*. The surface of the pressure roller 24 is pressed on the surface protection layer 22*c* of the heating member 22 through the film 23 at predetermined pressure force by a predetermined pressure mechanism (not shown). The rubber layer 24*a* of the pressure roller 24 is elastically deformed depending on the pressure force, and a nip portion N is formed between the surface of the pressure roller 24 and the surface of the film 23, the nip portion N having a predetermined width required for heat fixing unfixed toner image. The nip portion (fixing nip portion) N is formed between the pressure roller 24 and the heating member 22 by elastic deformation of the pressure roller 24 brought into contact with the heating member 22 by pinching the film 23. The pressure roller 24 is driven to rotate in a counterclockwise direction of an arrow b at predetermined circumferential velocity with drive force of a drive source M transferred through a drive transmission mechanism such as a gear (not shown).

The film 23 is rotated in a direction of an arrow a subordinate to rotation of the pressure roller 24 by rotating and driving the pressure roller 24 in the counterclockwise direction of the arrow b at least at the time of executing image forming.

(3) Pressure Roller 24

The above-mentioned pressure roller 24 is described in detail as follows on the point of material configuring the pressure roller and a manufacturing method.

3-1) Layer Configuration of Pressure Roller 24

Figure 3:
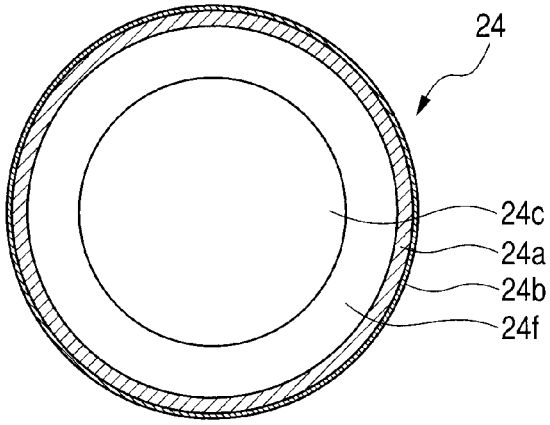
FIG. 3 is a layer configuration diagram of a model of a pressure roller.

FIG. 3 is a layer configuration diagram of a model of the pressure roller 24. The pressure roller 24 includes the round shaft metal core 24*c*, a solid rubber layer (first rubber layer) 24*f*, the self-bonded silicone rubber layer (second rubber layer) 24*a*, and the resin tube layer 24*b* as a surface layer. The self-bonded silicone rubber layer (second rubber layer) 24*a* is provided between the solid rubber layer (first rubber layer) 24*f* and the resin tube layer 24*b*.

3-1-1) Solid Rubber Layer (First Rubber Layer) 24*f*

A thickness of the entire rubber layer obtained by adding a thickness of the solid rubber layer 24*f* and a thickness of the self-bonded silicone rubber layer 24*a* described below is not limited in particular but is suitably 2 to 10 mm being a thickness capable of forming the nip portion N with a desired width, the solid rubber layer 24*f* and the self-bonded silicone rubber layer 24*a* being used for the pressure roller 24. The thickness of the solid rubber layer 24*f* within the above-mentioned range is not limited in particular but may be adjusted to attain a required thickness appropriately corresponding with hardness of the self-bonded silicone rubber layer 24*a* to be described in detail in the following item.

The general heat resistant solid rubber elastic material selected from the group consisting of one of silicone rubber and fluorine rubber can be used for the solid rubber layer 24*f*. Any of the materials provides sufficient heat resistance and endurance property and suitable elasticity (softness) in the case of use of the fixing apparatus 6. Accordingly, any of the silicone rubber and the fluorine rubber is suitable as main material for the solid rubber layer 24*f*.

The silicone rubber can be exemplified by addition type dimethyl silicone rubber as a representative example obtained by forming rubber bridging with dimethylpolysiloxane, for example, to undergo addition reaction with a vinyl group and silicon combined hydrogen group. As fluorocarbon rubber, binary, radial reaction type fluorocarbon rubber including a base polymer made of a binary copolymer of vinylidene fluoride and hexafluoropyrene obtained by forming a rubber bridge by a radical reaction with a peroxide can be exemplified as a representative example. Otherwise, ternary, radial reaction type fluorocarbon rubber including a base polymer made of a ternary copolymer of vinylidene fluoride, hexafluoropyrene, and tetrafluoroethylene obtained by forming a rubber bridge by a radical reaction with a peroxide can be exemplified as a representative example. However, in the pressure roller 24, *a* configuration obtained by applying so-called foamed sponge rubber, for example, instead of the solid rubber layer 24*f* is effective in terms of heat insulation but is inferior in terms of endurance performance, and hence it is important to use solid rubber as material for the solid rubber layer 24*f*.

The solid rubber layer 24*f* quoted here refers to one of a layer made of only rubber polymer which is not a foamed sponge rubber layer such as foamed sponge rubber, and a layer made of inorganic filler and rubber polymer which is not foamed sponge rubber.

In order to suppress thermal conduction to the metal core, a thermal conductivity A in the thickness direction (radial direction of the pressure roller) of the solid rubber layer 24*f* being non-foamed rubber layer is suitably set within a range from 0.16 W/m·K to 0.40 W/m·K. The thermal conductivity was measured with Quick Thermal Conductivity Meter QTM-500 being a product manufactured by KYOTO ELECTRONICS MANUFACTURING Co., LTD.

A method of forming the solid rubber layer 24*a* is not limited in particular. However, general form molding can be suitably adopted.

3-1-2) Self-Bonded Silicone Rubber Layer (Second Rubber Layer) 24*a*

The self-bonded silicone rubber layer 24*a* is formed between the solid rubber layer 24*f* and the resin tube layer 24*b*. The self-bonded silicone rubber layer 24*a* includes one of Type P and Type Q. Specifically, in Type P, hardening is performed on a composition 24*e* obtained by compounding an needle-shaped filler with an addition type silicone rubber composition 24*e*1 being a commercially-produced silicone rubber adhesive. In Type Q, hardening is performed on the composition 24*e* obtained by compounding an needle-shaped filler 24*d* and an adhesion-imparting agent with an addition type silicone rubber composition 24*e*2 containing no adhesion-imparting agent.

Figure 4A:
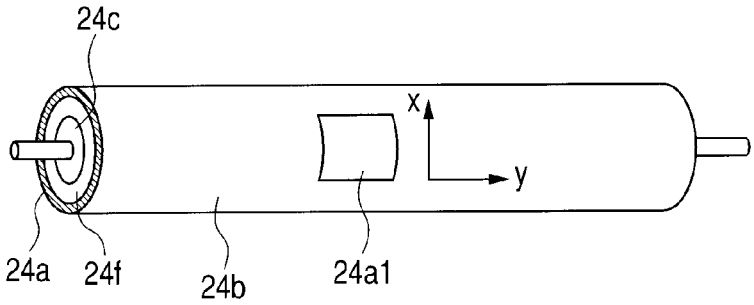
FIG. 4A is an entire perspective view of a rubber layer forming product obtained by molding a first rubber layer on a metal core and molding a second rubber layer on the first rubber layer.
Figure 4B:
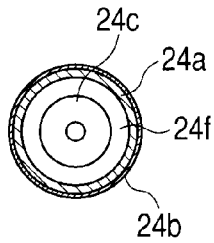
FIG. 4B is a right side view of the rubber layer forming product illustrated in FIG. 4A.
Figure 5:
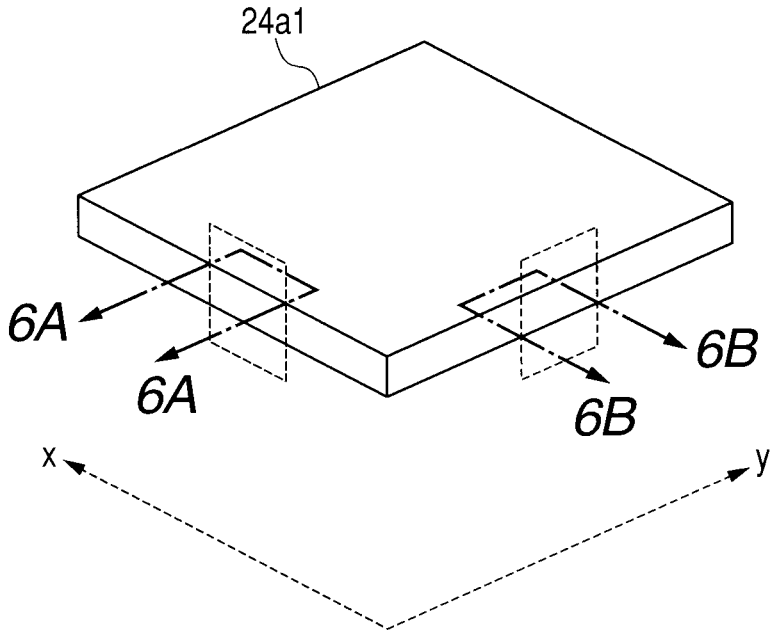
FIG. 5 is an enlarged perspective view of a cutout sample of the second rubber layer of the rubber layer forming product illustrated in FIG. 4A.
Figure 6A:
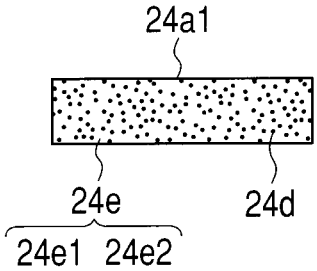
FIG. 6A is an enlarged sectional view of the cutout sample taken along the line 6A-6A of FIG. 5.
Figure 6B:
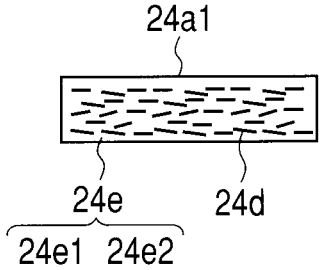
FIG. 6B is an enlarged sectional view of the cutout sample taken along the line 6B-6B of FIG. 5.
Figure 7:
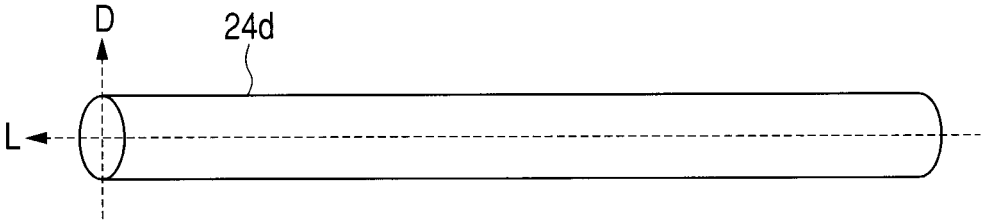
FIG. 7 is an explanatory diagram illustrating a fiber diameter portion and a fiber length portion of an needle-shaped filler.

With reference to FIGS. 4A to 7, an appearance of the needle-shaped filler 24*d* being orientated in the rubber layer 24*a* is described in detail. FIG. 4A is an entire perspective view of a rubber layer forming product obtained by molding the solid rubber layer 24*f* on the metal core 24*c* and molding the self-bonded silicone rubber layer 24*a* on the solid rubber layer 24*f*. FIG. 4B is a right side view of the rubber layer forming product illustrated in FIG. 4A. FIG. 5 is an enlarged perspective view of a cutout sample 24*a*1 of the self-bonded silicone rubber layer 24*a* illustrated in FIG. 4A. FIG. 6A is an enlarged sectional view of the cutout sample 24*a*1 taken along the line 6A-6A of FIG. 5. FIG. 6B is an enlarged sectional view of the cutout sample 24*a*1 taken along the line 6B-6B of FIG. 5. FIG. 7 is an explanatory diagram illustrating a fiber diameter portion D and a fiber length portion L of the needle-shaped filler 24*d*.

As illustrated in FIG. 4A, in the self-bonded silicone rubber layer 24*a* on the solid rubber layer 24*f*, the self-bonded silicone rubber layer 24*a* is cut and taken out in an x direction (peripheral direction) and in a y direction (longitudinal direction). A-section in the x direction and b-section in the y direction of the cut out sample of the rubber layer 24*a* are respectively observed as in FIG. 5. As a result, as for the a-section in the x direction, the fiber diameter portion D (see FIG. 7) of the needle-shaped filler 24*d* as in FIG. 6A is mainly observed. As for the b-section in the y direction, the fiber length portion L (see FIG. 7) of the needle-shaped filler 24*d* is frequently observed.

The addition type silicone rubber composition 24*e* for forming the self-bonded silicone rubber layer (second rubber layer) 24*a* of the pressure roller in the examples is described in detail.

In the case of the above-mentioned type P, the addition type silicone rubber composition (silicone rubber adhesive) 24*e*1 includes (1) diorganopolysiloxane containing an alkenyl group, (2) organohydrogenpolysiloxane, (3) a platinum-based curing catalyst, and (4) an adhesion imparting agent, and if required, a filler such as silica and colcothar and an additive are appropriately blended into the composition. In the examples, the addition type silicone rubber composition 24*e* is obtained by blending (5) an needle-shaped filler into the type-P addition type silicone rubber composition, and injecting the whole into a molding die.

In addition, in the case of the above-mentioned type Q, the addition type silicone rubber composition 24*e*2 includes (1) diorganopolysiloxane containing an alkenyl group, (2) organohydrogenpolysiloxane, and (3) a platinum-based curing catalyst, and if required, a filler such as silica and colcothar and an additive are appropriately blended into the composition. In the examples, the addition type silicone rubber composition 24*e* is obtained by blending (4) an adhesion imparting agent and (5) an needle-shaped filler into the type-Q addition type silicone rubber composition, and injecting the whole into a molding die.

When the self-bonded silicone rubber layer 24*a* of the pressure roller according to the present invention is formed, there may be used any one of the addition type silicone rubber composition 24*e*1 of Type P and the addition type silicone rubber composition 24*e*2 of Type Q as described above.

Next, regarding the addition type silicone rubber composition 24*e* used in this example, a representative and suitable example is described based on the above-mentioned addition type silicone rubber composition 24*e*1 of Type P. Note that, when the addition type silicone rubber composition 24*e*2 of Type Q is used, the basic configuration is the same as that of Type P, and hence description thereof is omitted.

(1) Diorganopolysiloxane Containing Alkenyl Group

A compound containing at least two alkenyl groups each binding to a silicon atom in one molecule is preferred as the component. Examples of the alkenyl group include a vinyl group and an allyl group, and a vinyl group is preferred. Further, other organic groups each binding to a silicon atom are preferably a monovalent hydrocarbon group having 10 or less carbon atoms. Examples thereof include: alkyl groups such as a methyl group, an ethyl group, a propyl group, and a butyl group; aryl groups such as a phenyl group and a tolyl group; and hydrocarbon groups in which hydrogen atoms are partially or wholly substituted by a halogen atom or the like, such as a chloromethyl group and a 3,3,3-trifluoropropyl group. Of those, a methyl group and a phenyl group are preferred. Diorganopolysiloxane containing those alkenyl groups and monovalent hydrocarbon groups having 10 or less carbon atoms is preferably liner. In addition, the alkenyl group may be present at any position in a molecular chain or at both termini of the molecular chain of diorganopolysiloxane, and the content thereof is preferably 0.05 to 10 mol % in the total organic groups.

(2) Organohydrogenpolysiloxane

Organohydrogenpolysiloxane is a crosslinking agent for curing a composition by an addition reaction with an alkenyl group in diorganopolysiloxane (1). Therefore, organohydrogenpolysiloxane must have at least two SiH groups in one molecule. In addition, the molecular structure thereof may be linear, cyclic, or branched. The use amount of organohydrogenpolysiloxane is preferably an amount in which the molar ratio [Si—H group]/[alkenyl group] of an Si—H group contained in organohydrogenpolysiloxane to an alkenyl group contained in diorganopolysiloxane (1) satisfies the range of 0.5 to 5.

(3) Platinum-Based Catalyst

A known component may be used, and examples thereof include chloroplatinic acid, alcohol modified chloroplatinic acid, and complexes of chloroplatinic acid and an olefin. The use amount thereof may be generally about 1 to 100 ppm with respect to the component (1).

(4) Adhesion Imparting Agent

A silicon compound having a functional group which imparts adhesive property is preferred as the component. Examples of the adhesion imparting component include trialkoxysilane having an aliphatic unsaturated functional group such as a vinyl group and a (meth)acryloxypropyl group, or an epoxy functional group such as a glycidoxypropyl group and a 3,4-epoxycyclohexylethyl group, and a functional group-containing organohydrogensiloxane oligomer having at least one, or preferably two or more silicon-atom-binding hydrogen atoms (that is, an SiH group) in one molecule, and at the same time, having, as a silicon-atom-binding monovalent group, at least one kind, or preferably two or more identical or different monovalent functional groups selected from: epoxy functional groups such as a glycidoxypropyl group and a 3,4-epoxycyclohexylethyl group; trialkoxysilyl functional groups such as a trimethylsilylethyl group and a triethylsilylethyl group; trialkenoxysilyl functional groups such as a tri(isopropenoxy)silylethyl group and a tri(isopropenoxy)silylpropyl group; ester functional groups such as an acetoxypropyl group and an acetoxyethyl group; complex functional groups having two or more kinds of structures of an ester functional group, an amide functional group, a trialkoxysilyl functional group, and the like, for example, $—(CH_2)_3—OCONH—(CH_2)_3—Si(OCH_3)_3$, $—(CH_2)_2—COO—(CH_2)_3—Si(OCH_3)_3$, and $—(CH_2)_3—OCO—(CH_2)_3—COO—(CH_2)_3—Si(OCH_3)_3$; and an acid anhydride functional group such as a carboxilic acid anhydride group. In this case, a compound having about 2 to 10 silicon atoms forming the siloxane structure in the above siloxane oligomer is used. The molecular structure of siloxane may be linear or cyclic, and in particular, tetracyclosiloxane (siloxane cyclic tetramer) is preferably used.

(5) Needle-Shaped Filler (Elongated Fiber Filler)

In the needle-shaped filler 24*d* illustrated in FIG. 7, if an average value of the fiber length portion L is shorter than 50 μm, a thermal conductivity anisotropic effect hardly appears in the self-adhesive silicone rubber layer 24*a*. In other words, if thermal conductivity is high in the longitudinal direction and low in the periphery direction of the pressure roller of the self-adhesive silicone rubber layer 24*a*, energy saving can be planned also in obtaining the same fixing performance, because the large amount of heat generated at the non-sheet feeding region of the roller axis direction can be transferred from the non-sheet feeding region to the center portion effectively. If the average value of the fiber length portion L is longer than 1 mm, dispersed process molding of the filler 24*d* into the highly thermal conductive elastic rubber layer 24*b* is difficult. Consequently, the length of the filler 24*d* is preferably 0.05 mm or more and 1 mm or less.

As the above-mentioned needle-shaped filler 24*d*, pitch-based carbon fiber manufactured by adopting oil pitch and coal pitch as row material is suitable due to the thermal conductive performance of the needle-shaped filler 24*d*.

The needle-shaped filler 24*d* has a thin fiber shape. Thus, when the needle-shaped filler 24*d* is kneaded with the liquid addition type silicone rubber composition 24*e*1 prior to hardening to be injected into a molding die, the axis of the filler is likely to be orientated in the direction of stream in the molding die, in other words, in the longitudinal direction (roller axis direction) of the second rubber layer 24*a*. Consequently, when the liquid addition type silicone rubber composition 24*e* is hardened and thus the second rubber layer 24*a* is molded, a thermal conductivity in the roller axis direction of the second rubber layer can be intensified.

Next, the configuration of the self-bonded silicone rubber layer (second rubber layer) 24*a* is described in detail.

A thickness of the second rubber layer 24*a* of 0.5 mm or more and 5.0 mm or less is suitable for molding in terms of performance. In a case where the thickness is smaller than 0.5 mm, when an attempt is made to obtain a satisfactory effect of moderating temperature rise at a non-sheet feeding portion, it is necessary to mix a larger amount of the needle-shaped filler 24*d* with the liquid-state silicone rubber composition 24*e*1. However, when the liquid-state silicone rubber composition 24*e*1 contains the extremely large amount of the needle-shaped filler 24*d*, viscosity of the self-bonded silicone rubber composition 24*e* is extremely high, with the result that it is difficult to mold the pressure roller. Alternatively, in a case where the thickness is larger than 5.0 mm, the needle-shaped filler 24*d* is not likely to be orientated in the longitudinal direction of the second rubber layer 24*a* when the pressure roller is molded (when the liquid-state silicone rubber composition 24*e* is injected into the molding die).

Here, the lower limit of content amount in the liquid-state silicone rubber composition 24*e* of the needle-shaped filler 24*d* is 5 vol %. If the lower limit is under 5 vol %, the thermal conductivity is reduced so that it is impossible to obtain the desired effect of moderating temperature rise at the non-sheet feeding portion. The upper limit of content amount in the liquid-state silicone rubber composition 24*e* of the needle-shaped filler 24*d* is 40 vol %. If the upper limit is over 40 vol %, performing of the process molding is difficult. A volumetric percentage of the needle-shaped filler 24*d* is obtained by the following formula:

(entire volume of filler contained in the liquid addition type silicone rubber composition)/(volume of the liquid addition type silicone rubber composition+ entire volume of filler contained in the liquid addition type silicone rubber composition)×100 vol %.

Further, in order to increase the effect of moderating temperature rise at the non-sheet feeding portion, the thermal conductivity λ in the longitudinal direction of the needle-shaped filler 24*d* is required to be 500 W/m·K or more. The thermal conductivity λ was measured by laser flash method with use of a Laser Flash Method Thermal Constant Measuring System TC-7000 provided by ULVAC-RIKO, Inc. When the thermal conductivity λ is under 500 W/m·K, the effect of moderating temperature rise at the non-sheet feeding portion is reduced.

If an average length of the needle-shaped filler 24*d* is smaller than 50 μm, a thermal conductivity anisotropic effect hardly appears in the second rubber layer 24*a*, and the effect of moderating temperature rise at the non-sheet feeding portion is reduced. If the average length of the needle-shaped filler 24*d* is larger than 1 mm, when being kneaded with the liquid addition type silicone rubber composition, the viscosity of the liquid addition type silicone rubber composition is extremely high, with the result that cast processing is difficult. Note that, the average length of the needle-shaped filler 24*d* is determined by optical observation.

Further, when the thermal conductivity of the second rubber layer 24*a* in the longitudinal direction (roller axis direction) orthogonal to a recording material conveyance direction is 2.5 W/m·K or more, it is possible to obtain the effect of moderating temperature rise at the non-sheet feeding portion. A measurement method for the thermal conductivity of the second rubber layer 24*a* is described in detail below.

Figure 8:
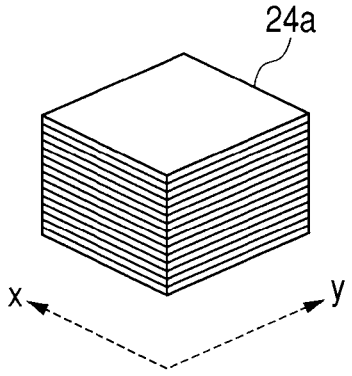
FIG. 8 is an explanatory diagram illustrating a step of measuring a thermal conductivity of the second rubber layer.

Regarding the thermal conductivity of the second rubber layer 24*a* in the recording material conveyance direction (peripheral direction: x direction) and in its crossing direction (longitudinal direction: y direction), measurement can be performed with use of Hot Disk Method Thermophysical Properties Analyzer (TPA-501) provided by KYOTO ELECTRONICS MANUFACTURING CO., LTD. In order to secure the thickness sufficient for measurement, as illustrated in FIG. 5, only the rubber layer 24*a* is cut out to form a test sample to be measured by stacking the appropriate number of sheets as illustrated in FIG. 8.

Figure 9:
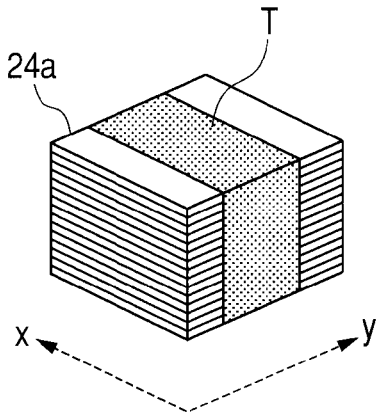
FIG. 9 is an explanatory diagram illustrating the step of measuring the thermal conductivity of the second rubber layer.
Figure 10:
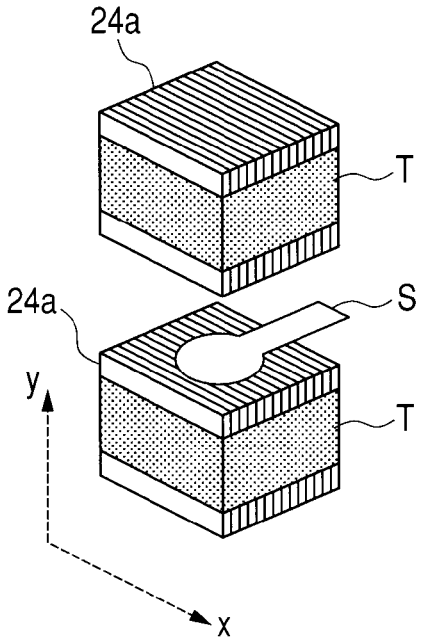
FIG. 10 is an explanatory diagram illustrating the step of measuring the thermal conductivity of the second rubber layer.

In this example, the second rubber layer 24*a* is cut out at the dimensions of 15 mm (in x direction)×15 mm (in y direction)×thickness (set thickness), and is stacked to have a thickness of approximately 15 mm, thereby attaining a test sample to be measured. Upon measurement of the thermal conductivity, as illustrated in FIG. 9, the test sample to be measured is fixed with a kapton tape T having a thickness of 0.07 mm and a width of 10 mm. Next, in order to equalize the level of flatness of the surface to be measured of the test sample, the surface to be measured and the rear surface of the surface to be measured are cut with a razor. Then, as illustrated in FIG. 10, two sets of the above-mentioned test sample to be measured are prepared. A sensor S is pinched by the two test samples to be measured to measure the thermal conductivity. In a case where the test sample to be measured is measured while being subjected to a change in the direction (x direction and y direction), the measurement direction may be changed to carry out the method as described above. Note that, in this example, an average value of the five times of measurement was used.

3-1-3) Resin Tube 24*b*

The resin tube 24*b* is arranged on the second rubber layer 24*a*. Specifically, one of a PFA tube and an FEP tube is suitably used as the resin tube 24*b*. However, the resin tube 24*b* is not limited thereto. The thickness of the tube 24*b* is not limited in particular if the above-mentioned thickness can give sufficient mold-releasing performance to the pressure roller 24.

3-1-4) Manufacturing Method for Pressure Roller

Figure 11A:
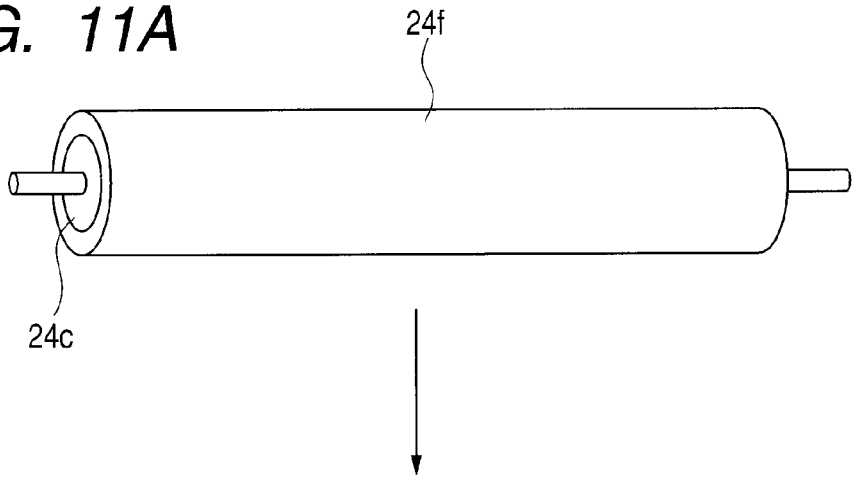
FIG. 11A and FIG. 11B are an explanatory diagram illustrating molding procedure for a pressure roller according to each of Examples 1 to 4.
Figure 11B:
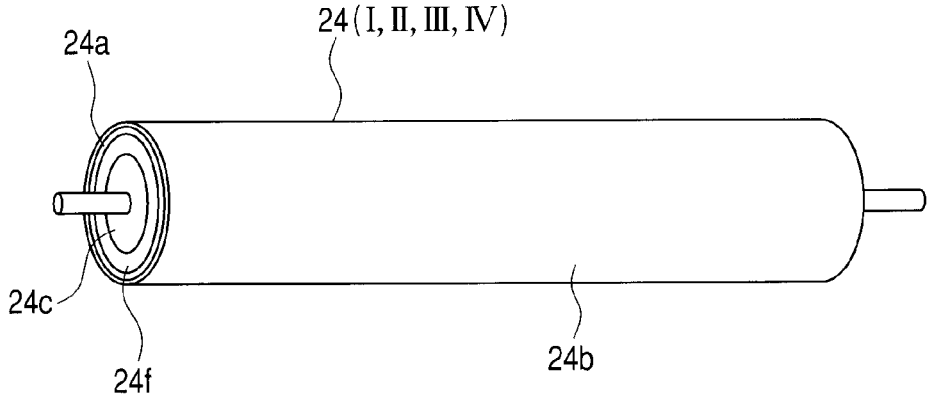

A manufacturing method for the pressure roller is described with reference to FIGS. 11A, 11B, and 12. First, the solid rubber layer (first rubber layer) 24*f* made of addition type silicone rubber is formed on the metal core 24*c* (see FIG. 11A). Another rubber layer may be sandwiched between the metal core 24*c* and the first rubber layer 24*f*. As a molding method for the first rubber layer, a cast molding method with use of a molding die is suitably adopted.

Next, as a molding method for the self-bonded silicone rubber layer (second rubber layer) 24*a*, a cast molding method is mainly used. In the following, the molding method for the second rubber layer 24*a* is specifically described.

Figure 12:
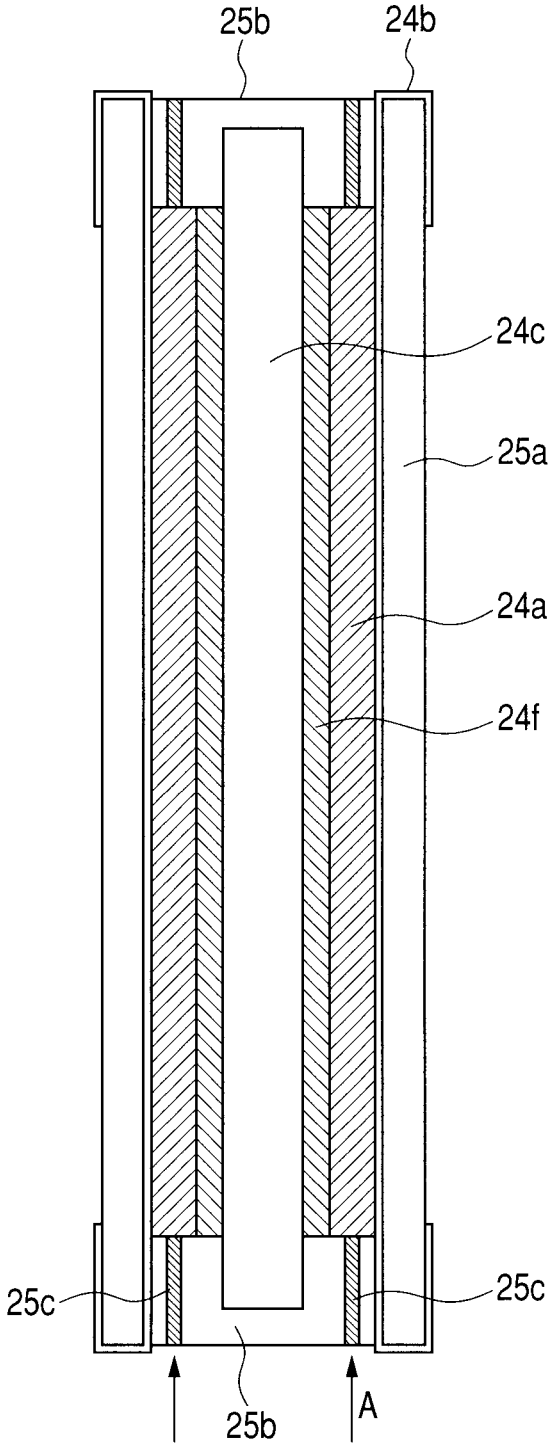
FIG. 12 is an explanatory diagram illustrating a manufacturing method for the pressure roller according to each of Examples 1 to 4.

As illustrated in FIG. 12, the resin tube 24*b* is placed in the inside of (on the inner surface of) a molding die 25*a* having a cylindrical inner surface (step of placing the resin tube on the inner surface of the molding die). Further, in the inside of the resin tube, the metal core 24*c* having the first rubber layer 24*f* formed therein is placed to be coaxial with the center of the molding die 25*a* (step of placing the metal core provided with the solid rubber layer at the center of the molding die having the cylindrical inner surface). Note that, the surface of the resin tube to be opposed to the metal core is subjected to etching in advance. Note that, also in a conventional method of bonding the resin tube and the rubber layer together with use of primer, such etching is necessary for bonding the resin tube and the rubber layer together.

At each of axial both ends of the die 25*a*, there is placed an insert die 25*b* having holes 25*c* which are drilled therein and through which the liquid addition type silicone rubber composition 24*e* is injected. The unhardened liquid addition type silicone rubber composition 24*e* containing the needle-shaped filler 24*d* is injected between the tube 24*b* and the first rubber layer 24*f* through the holes 25*c* in an axial direction (direction of an arrow A of FIG. 12). As a result, the needle-shaped filler 24*d* compounded with the liquid addition type silicone rubber composition 24*e* is orientated in the roller axis direction (step of injecting the liquid addition type silicone rubber containing the adhesion-imparting agent and the needle-shaped filler between the resin tube and the metal core provided with the solid rubber layer). After injection, depending on kinds of the liquid addition type silicone rubber composition 24*e* in use, heating and hardening are performed under an optimum heating condition, and then releasing from the die 25*a* is performed. After carrying out a step of cutting redundant hardened silicone rubber remaining on the end surface, the pressure roller 24 is obtained (see FIG. 11B).

As described above, the inner surface of the tube 24*b* is subjected to etching in advance, and the second rubber layer 24*a* and the tube 24*b* are bonded together in the process in which the liquid addition type silicone rubber composition 24*e* is hardened to form the second rubber layer 24*a* (step of hardening the liquid addition type silicone rubber and bonding the resin tube and the silicone rubber together by an action of the adhesion-imparting agent). The present invention has such a feature that the tube 24*b* and the second rubber layer 24*a* are directly bonded together without using a method of applying primer between the tube 24*b* and the second rubber layer 24*a* upon the above-mentioned bonding.

The molding method for the second rubber layer 24*a* is not limited to the above-mentioned method, as long as the second rubber layer 24*a* is formed by injecting the liquid addition type silicone rubber composition into a cylindrical molding die as in a case of the cast molding method. Further, the molding method for the first rubber layer 24*f* is not limited in particular.

3-2) Examples of Pressure Roller 24

In the following, the present invention is described by way of examples. First, the needle-shaped filler 24*d* used in each of the pressure rollers 24 according to Examples 1 to 4 is described. As the needle-shaped filler 24*d*, the following four kinds of pitch-based carbon fiber are used. Regarding the pressure rollers 24, *a* pressure roller I24, a pressure roller II24, a pressure roller III24, and a pressure roller IV24 are used in the Examples 1 to 4, respectively.

(A) Needle-Shaped Filler to be Used in the Pressure Roller I24 of Example 1 and the Pressure Roller II24 of Example 2

Type: 100-15M: pitch-based carbon fiber

Product Name: XN-100-15M (manufactured by Nippon Graphite Fiber Corporation)

Average fiber diameter: 9 μm

Average fiber length L: 150 μm

Thermal conductivity of 900 W/m·K (B) Needle-Shaped Filler to be Used in the Pressure Roller III24 of Example 3

Type: 100-05M: pitch-based carbon fiber

Product Name: XN-100-05M (manufactured by Nippon Graphite Fiber Corporation)

Average fiber diameter: 9 μm

Average fiber length L: 50 μm

Thermal conductivity of 900 W/m·K (C) Needle-Shaped Filler to be Used in the Pressure Roller IV24 of Example 4

Type: 100-01: pitch-based carbon fiber

Product Name: XN-100-01 (manufactured by Nippon Graphite Fiber Corporation)

Average fiber diameter: 10 μm

Average fiber length L: 1 mm

Thermal conductivity of 900 W/m·K

Example 1

The molding method for the pressure roller 24 is described with reference to FIGS. 11A, 11B, and 12. First, on the outer periphery of the metal core 24*c* made of Al (aluminum) with a diameter of 422 (mm), a rubber layer forming product 24*f* as the first rubber layer with a thickness of 3.0 mm and a diameter of Φ28 (mm) is formed by a die molding method with used of addition type silicone rubber with density of 1.20 g/cm$^3$ (see FIG. 11A).

Next, the molding method for the second rubber layer 24*a* is described. Liquid A and Liquid B of Product name: SE1819CV A&B (manufactured by Dow Corning Toray Co., Ltd.) serving as the liquid addition type silicone rubber composition are mixed together at a proportion of 1:1, and thus the liquid addition type silicone rubber composition 24*e*1 is obtained. The SE1819CV A&B is the above-mentioned liquid addition type silicone rubber composition (silicone rubber adhesive) 24*e*1 of Type P.

Here, in a case of using the liquid addition type silicone rubber composition 24*e*1 of Type P, when the second rubber layer 24*a* is heated and hardened, the second rubber layer 24*a* and the tube 24*b*, and the second rubber layer 24*a* and the first rubber layer 24*f* are bonded together without primer. Product name: SE1816CV (manufactured by Dow Corning Toray Co., Ltd.) and Product name: TSE322SX (manufactured by Momentive Performance Materials Japan) also allow such bonding without primer. Note that, the liquid addition type silicone rubber composition (silicone rubber adhesive) of Type P is developed mainly for use as an adhesive, and the silicone rubber adhesive has variety in terms of viscosity. However, in this example, the silicone rubber adhesive functions not only as an adhesive but also as the rubber layer of the pressure roller. In particular, in order to increase the thermal conductivity in the axial direction of the pressure roller, the needle-shaped filler is required to be dispersed with 5 vol % or more and 40 vol % or less, and hence the second rubber layer 24*a* according to this example is required to have a thickness of 0.5 mm or more and 5.0 mm or less. When forming the rubber layer required to have such thickness, it is necessary to form the rubber layer by injecting liquid-state rubber into a molding die. Therefore, the silicone rubber adhesive for forming the second rubber layer of the pressure roller according to this example is required to have appropriate viscosity. The viscosity of the liquid addition type silicone rubber composition for forming the second rubber layer is suitably 2 Pa·s (Pa·sec) or more and 100 Pa·s or less (measurement method for the viscosity is compliant with JISK6249 (test method for unhardened and hardened silicone rubber)). The viscosity thereof is more suitably 2 Pa·s or more and 60 Pa·s or less. If the viscosity is under 2 Pa·s, the needle-shaped filler and the liquid addition type silicone rubber are separated from each other, which is not suitable. Further, if the viscosity is over 100 Pa·s, the viscosity is extremely high. As a result, it is difficult to inject the liquid addition type silicone rubber composition into the die, and orientating property of the needle-shaped filler is deteriorated.

In Example 1, for the liquid addition type silicone rubber composition 24*e*1, pitch-based carbon fiber 100-15M was uniformly composed and mixed at 25 vol % as the needle-shaped filler 24*d* so as to obtain the self-bonded silicone rubber composition 24*e* to be injected into the die.

Next, as illustrated in FIG. 12, a PFA tube (with a thickness of 50 μm) 24*b* having a surface subjected to etching is placed in the inside of a die with an inner diameter of Φ30 (mm), the surface of the PFA tube being opposed to the first rubber layer. In addition, the first rubber layer forming product 24*f* with the diameter of Φ28 (mm) is placed in the inside of the PFA tube to be coaxial with the center of the die. Then, the self-bonded silicone rubber composition 24*e* is injected between the PFA tube 24*b* and the first rubber layer forming product 24*f* in the direction of the arrow A. After performing heating and hardening at 200° C. for 30 minutes, a pressure roller I with an outer diameter of Φ30 (mm) and an axial length of 320 mm was obtained (see FIG. 11B). When performing such heating and hardening, the second rubber layer 24*a* and the tube 24*b*, and the second rubber layer 24*a* and the first rubber layer 24*f* are bonded together. Further, the thickness of the rubber layer 24*a* is 1.0 mm.

Further, in a case where it is difficult to bond the rubber layers together without primer unlike the combination of the second rubber layer 24*a* and the first rubber layer 24*f* in Example 1, bonding with use of primer may be adopted. In this case, as the primer, for example, Product name: DY39-051A&B manufactured by Dow Corning Toray Co., Ltd. may be used.

Example 2

Similarly to Example 1, a first rubber layer forming product 24*f*1 is formed as the first rubber layer 24*f* with a thickness of 3.5 mm and a diameter of Φ29 (mm). Next, similarly to Example 1, the self-bonded silicone rubber composition 24*e* was obtained.

Further, similarly to Example 1, *a* pressure roller II with an outer diameter of Φ30 (mm) and an axial length of 320 mm was obtained. When performing such heating and hardening, the second rubber layer 24*a* and the tube 24*b*, and the second rubber layer 24*a* and the first rubber layer 24*f* are bonded together. Further, the thickness of the second rubber layer 24*a* is 0.5 mm.

Example 3

Similarly to Example 1, *a* rubber layer forming product 24*f*1 is formed as the first rubber layer 24*f* with a thickness of 3.5 mm and a diameter of Φ29 (mm).

Next, the molding method for the second rubber layer 24*a* by cast molding is described.

Liquid A and Liquid B of Product name: SE1819CV A&B (manufactured by Dow Corning Toray Co., Ltd.) serving as the liquid addition type silicone rubber composition are mixed together at a proportion of 1:1, and thus the liquid addition type silicone rubber composition 24*e*1 is obtained. For the liquid addition type silicone rubber composition 24*e*1, pitch-based carbon fiber 100-05M was uniformly composed and mixed at 5 vol % as the needle-shaped filler 24*d* so as to obtain the self-bonded silicone rubber composition 24*e*.

Next, similarly to Example 1, *a* pressure roller III with an outer diameter of Φ30 (mm) and a longitudinal length of 320 mm was obtained. When performing such heating and hardening, the second rubber layer 24*a* and the tube 24*b*, and the second rubber layer 24*a* and the first rubber layer 24*f* are bonded together. Further, the thickness of the second rubber layer 24*a* is 0.5 mm.

Example 4

Similarly to Example 1, the rubber layer forming product 24*f*1 is formed as the first rubber layer 24*f* with a thickness of 3.0 mm and a diameter of Φ28 (mm). Next, a molding method for the second rubber layer 24*a* by cast molding is described.

Liquid A and Liquid B of Product name: SE1819CV A&B (manufactured by Dow Corning Toray Co., Ltd.) serving as the liquid addition type silicone rubber composition are mixed together at a proportion of 1:1, and thus the liquid addition type silicone rubber composition 24*e*1 is obtained.

For the liquid addition type silicone rubber composition 24*e*1, pitch-based carbon fiber 100-01 was uniformly composed and mixed at 40 vol % as the needle-shaped filler 24*d* so as to obtain the self-bonded silicone rubber composition 24*e*.

Further, similarly to Example 1, *a* pressure roller IV with an outer diameter of Φ30 (mm) and a longitudinal length of 320 mm was obtained. When performing such heating and hardening, the second rubber layer 24*a* and the tube 24*b*, and the second rubber layer 24*a* and the first rubber layer 24*f* are bonded together. Further, the thickness of the second rubber layer 24*a* is 1.0 mm.

Further, when an attempt was made to mold the pressure roller provided with the second rubber layer 24*a* having the thickness smaller than 0.5 mm, molding was difficult. Therefore, molding was impossible as long as the pressure roller was provided with the second rubber layer 24*a* having the thickness of 0.5 mm or more.

Comparative Example 1

A roller described below was produced as a comparative example.

A pressure roller with an outer diameter of ϕ30 (mm) and a longitudinal length of 320 mm was obtained by the following manner. That is, the pressure roller was formed by molding silicone rubber having the thermal conductivity of 0.4 W/m·K between a metal core with a diameter of Φ22 (mm) made of Al and the PFA tube (with a thickness of 50 μm) so that the pressure roller was provided with not two rubber layers but only one rubber layer having a thickness of 4 mm unlike in the case of examples. In this case, the silicone rubber has no self-bonded property, and hence bonding between the metal core and the rubber layer, and bonding between the rubber layer and the tube are performed with use of primer.

3-3) Assessment on Pressure Roller 24

<Performance Assessment>

<Adhesive Property Assessment>

For adhesive property assessment, five fixing apparatuses of a film heating system, which respectively include the pressure rollers 24 according to Examples 1 to 4 and Comparative Example 1 manufactured by the above-mentioned methods, were respectively mounted on printers having the same configuration. Then, in each of the printers, the circumferential velocity (process speed) of the pressure roller 24 of the fixing apparatus was adjusted to attain 234 mm/sec. A fixing temperature was set to 220° C. That is, the sheet having undergone sheet feeding (been introduced) as the recording material P at the nip portion N in the fixing apparatus is a sheet with an LTR longitudinal-sized sheet (75 g/m2). 200,000 sheets underwent sheet feeding continuously at 50 sheets per minute. After that, whether or not the second rubber layer 24*a* and the tube 24*b* were peeled off was assessed by visual observation and by pulling the tube with hand.

<Assessment on Temperature Rise at Non-Sheet Feeding Portion>

For assessment on the temperature rise at the non-sheet feeding portion, in the same configuration as the above-mentioned configuration, the temperature of the surface of the film 23 in a non-sheet feeding area (area where the LTR longitudinal-sized sheet does not pass) was measured at the time when 500 sheets have undergone sheet feeding continuously.

<Assessment Results>

Assessment results are shown in Table 1.

TABLE 1

| | Pressure member No | Carbon fiber Type | Carbon fiber Rate of content (vol %) | Thickness of first elastic layer 24d (mm) | Thickness of second elastic layer 24a (mm) | Rubber with dispersed fiber Thermal conductivity W/(m · K) y direction | Film surface Temperature at non-sheet feeding portion (° C.) | Film surface Improvement effect | Film surface Adhesive property |
|---|---|---|---|---|---|---|---|---|---|
| Example 1 | I | 100-15M | 25 | 3.0 | 1.0 | 19.8 | 265 | ◎ | ○ |
| Example 2 | II | 100-15M | 25 | 3.5 | 0.5 | 10.3 | 270 | ◎ | ○ |
| Example 3 | III | 100-05M | 5 | 3.5 | 0.5 | 2.5 | 289 | ○ | ○ |
| Example 4 | IV | 100-01 | 40 | 3.0 | 1.0 | 90.5 | 249 | ◎ | ○ |
| comparative Example 1 | V | — | — | — | — | 0.4 | 310 | — | — |

In the fixing apparatus provided with the pressure roller according to Comparative Example 1, the thermal conductivity of the rubber layer was 0.4 W/m·K, and the temperature at the non-sheet feeding portion was 310° C. In the following, the assessment on the temperature rise at the non-sheet feeding portion was compared based on the results.

In the second rubber layer 24*a* and the tube 24*b* of the pressure roller I according to Example 1, no peeling was seen in an interface therebetween, and bonding performance remained good. Further, in the fixing apparatus provided with such pressure roller, the second rubber layer 24*a* contains carbon fiber. Therefore, the thermal conductivity of the second rubber layer 24*a* in the axial direction was 19.8 W/m·K, and the temperature in the non-sheet feeding area was 265° C., and hence a temperature rise suppression effect is seen in the non-sheet feeding area when compared to Comparative Example 1.

In the second rubber layer 24*a* and the tube 24*b* of the pressure roller II according to Example 2, no peeling was seen in an interface therebetween, and bonding performance remained good. Further, in the fixing apparatus provided with such pressure roller, the thickness of the second rubber layer is set to 0.5 mm. However, the thermal conductivity was 10.3 W/m·K, and the temperature in the non-sheet feeding area was 270° C. The temperature rise suppression effect is seen in the non-sheet feeding area when compared to Comparative Example 1, though not to the extent of Example 1.

In the second rubber layer 24*a* and the tube 24*b* of the pressure roller III according to Example 3, no peeling was seen in an interface therebetween, and bonding performance remained good. Further, in the fixing apparatus provided with such pressure roller, the content amount of carbon fiber in the second rubber layer 24*a* is small, the fiber length of the carbon fiber is small, and the second rubber layer 24*a* has thin thickness. Therefore, though the effect is inferior to that of Example 1, the thermal conductivity of the second rubber layer 24*a* in the axial direction was 2.5 W/m·K, and the temperature in the non-sheet feeding area was 289° C., and hence the temperature rise suppression effect is seen in the non-sheet feeding area when compared to Comparative Example 1.

In the second rubber layer 24*a* and the tube 24*b* of the pressure roller IV according to Example 4, no peeling was seen in an interface therebetween, and bonding performance remained good. Further, in the fixing apparatus provided with such pressure roller, the content amount of carbon fiber in the second rubber layer 24*a* is large, and the fiber length of the carbon fiber is large. The content amount and the fiber length in this example are upper limits allowing the needle-shaped filler 24*d* to be contained in the liquid addition type silicone rubber composition 24*e*. In this case, the thermal conductivity of the second rubber layer 24*a* in the axial direction was 90.5 W/m·K, and the temperature in the non-sheet feeding area was 245° C. The temperature rise suppression effect is seen in the non-sheet feeding area more significantly than in Example 1.

As described above, the rubber layer provided on the metal core includes the solid rubber layer and the self-bonded silicone rubber layer. The solid rubber layer has the thermal conductivity in the thickness direction of 0.16 W/m·K or more and 0.40 W/m·K or less. The self-bonded silicone rubber layer contains the needle-shaped filler at 5 vol % or more and 40 vol % or less, has the thermal conductivity in the roller axis direction of 2.5 W/m·K or more and the thickness of 0.5 mm or more and 5.0 mm or less, and is provided between the solid rubber layer and the resin tube layer, the needle-shaped filler having the average length of 0.05 mm or more and 1 mm or less and the thermal conductivity of 500 W/m·K or more in the length(axial) direction of the needle-shaped filler. With this configuration, it is possible to provide a pressure roller, a manufacturing method for the pressure roller, and an image heating apparatus using the pressure roller, the pressure roller being configured to allow to moderate the temperature rise at the non-sheet feeding portion, and to bond the second rubber layer 24*a* and the tube 24*b* together without primer to thereby simplify manufacturing steps.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-328015, filed Dec. 24, 2008, which is hereby incorporated by reference herein in its entirety.

The invention claimed is:

1. An image heating apparatus for heating a toner image formed on a recording material, comprising:

a heat member configured to heat the toner image formed on the recording material; and a pressure roller comprising a metal core, a rubber layer, and a resin tube layer serving as a surface layer, the pressure roller forming, in cooperation with the heat member, a nip portion at which the recording material is pinched and conveyed, wherein the rubber layer comprises a first rubber layer, and a second rubber layer provided between the first rubber layer and the resin tube layer and having a higher thermal conductivity than that of the first rubber layer, wherein the second rubber layer contains needle-shaped fillers at 5 vol % or more and 40 vol % or less, and has a thermal conductivity of 2.5 W/m·K or more in an axial direction of the pressure roller, the needle-shaped fillers having an average length of 0.05 mm or more and 1 mm or less and a thermal conductivity of 500 W/m·K or more in an axial direction of the needle-shaped filler, and wherein the second rubber layer is formed by a silicone rubber containing an adhesion-imparting agent and is bonded with the resin tube layer directly by an act of the adhesion-imparting agent.

2. An image heating apparatus according to claim 1, wherein the needle-shaped filler is pitch-based carbon fiber.

3. An image heating apparatus according to claim 1, wherein:

the heat member comprises an endless belt and a heater brought into contact with an inner surface of the endless belt; and the nip portion is formed by the heater and the pressure roller while the endless belt is interposed in the nip portion.

4. A pressure roller to be used in an image heating apparatus for heating a toner image formed on a recording material, comprising:

a metal core;

a rubber layer; and a resin tube layer serving as a surface layer, wherein the rubber layer comprises a first rubber layer, and a second rubber layer provided between the solid rubber layer and the resin tube layer and having a higher thermal conductivity than that of the first rubber layer, wherein the second self bonded silicone rubber layer contains needle-shaped fillers at 5 vol % or more and 40 vol % or less, and has a thermal conductivity of 2.5 W/m·K or more in an axial direction of the pressure roller, the needle-shaped fillers having an average length of 0.05 mm or more and 1 mm or less and a thermal conductivity of 500 W/m·K or more in an axial direction of the needle-shaped filler, and wherein the second rubber layer is formed by a silicone rubber containing an adhesion-imparting agent and is bonded with the resin tube layer directly by an act of the adhesion-imparting agent.

5. A pressure roller according to claim 4, wherein the needle-shaped filler is pitch-based carbon fiber.

6. A manufacturing method for a pressure roller to be used in an image heating apparatus, the pressure roller comprising: a metal core; a resin tube layer serving as a surface layer; a first rubber layer; and a second rubber layer provided between the solid rubber layer and the resin tube layer and having a higher thermal conductivity than that of the first rubber layer, the second rubber layer contains needle-shaped fillers at 5 vol % or more and 40 vol % or less, and has a thermal conductivity of 2.5 W/m·K or more in an axial direction of the pressure roller, the needle-shaped fillers having an average length of 0.05 mm or more and 1 mm or less and a thermal conductivity of 500 W/m·K or more in an axial direction of the needle-shaped filler, the manufacturing method comprising:

placing the metal core provided with the first rubber layer at a center of a molding die having a cylindrical inner surface;

placing the resin tube layer on the inner surface of the molding die;

injecting liquid addition type silicone rubber containing an adhesion-imparting agent and the needle-shaped fillers between the resin tube layer and the metal core provided with the first rubber layer; and molding the second rubber layer by hardening the liquid addition type silicone rubber; and bonding the second rubber layer to the resin tube layer directly by an action of the adhesion-imparting agent.

7. A manufacturing method for a pressure roller according to claim 6, wherein the needle-shaped filler is pitch-based carbon fiber.

8. An image heating apparatus according to claim 1, wherein the first rubber layer is a solid rubber layer which has a thermal conductivity of 0.16 W/m·K or more and 0.40 W/m·K or less in a thickness direction of the first rubber layer.

9. A pressure roller according to claim 4, wherein the first rubber layer is a solid rubber layer which has a thermal conductivity of 0.16 W/m·K or more and 0.40 W/m·K or less in a thickness direction of the first rubber layer.

10. A manufacturing method for a pressure roller according to claim 6, wherein the first rubber layer is a solid rubber layer which has a thermal conductivity of 0.16 W/m·K or more and 0.40 W/m·K or less in a thickness direction of the first rubber layer.

11. An image heating apparatus according to claim 1, wherein the second rubber layer has a thickness of 0.5 mm or more and 5.0 mm or less.

12. A pressure roller according to claim 4, wherein the second rubber has a thickness of 0.5 mm or more and 5.0 mm or less.

13. A manufacturing method for a pressure roller according to claim 6, wherein the second rubber layer has a thickness of 0.5 mm or more and 5.0 mm or less.

* * * * *